US005563923A

United States Patent [19]

Okada et al.

[11] Patent Number: 5,563,923

[45] Date of Patent: Oct. 8, 1996

[54] X-RAY TUBE

[75] Inventors: Tomoyuki Okada; Masuo Ito; Tsutomu Nakamura; Mitsumasa Furukawa, all of Hamamatsu, Japan

[73] Assignee: Hamamatsu Photonics K. K., Shizuoka-ken, Japan

[21] Appl. No.: 429,130

[22] Filed: Apr. 26, 1995

[30] Foreign Application Priority Data

Apr. 26, 1994 [JP] Japan ..... 6-088299

[51] Int. Cl.[6] ..... H01J 35/14

[52] U.S. Cl. ..... 378/138; 378/143

[58] Field of Search ..... 378/138, 143

[56] References Cited

U.S. PATENT DOCUMENTS

| | | | |
|---|---|---|---|
| 4,400,824 | 8/1983 | Shidara | 378/143 |
| 5,077,771 | 12/1991 | Skillicorn et al. | 378/102 |

FOREIGN PATENT DOCUMENTS

| | | |
|---|---|---|
| 61-22545 | 1/1986 | Japan . |
| 61-206140 | 9/1986 | Japan . |
| 62-44449 | 11/1987 | Japan . |

*Primary Examiner*—Craig E. Church

*Attorney, Agent, or Firm*—Sughrue, Mion, Zinn, Macpeak & Seas

[57] ABSTRACT

An x-ray tube 100 mainly includes an electron gun assembly 110 and a target assembly 210 which are arranged at right angles. In the target assembly 210, an x-ray target 211 is enclosed in a cylindrically-shaped hood electrode 212. Electrons emitted from the electron gun assembly 110 enters the hood electrode through an electron beam opening 215 to collide with the x-ray target 212, whereupon x-rays are generated. X-rays travel in an x-ray emitting direction R along the central axis of the hood electrode to emit outside of the hood electrode through an x-ray opening 216. A protrusion 212*a* is formed on the periphery of the hood electrode 212 downstream of the electron opening 215 in the x-ray emitting direction R.

21 Claims, 11 Drawing Sheets

100
110
112
114
111
113
113₁
113₂
135
215
212a
214
216
R
+H.V.
212
211
213
210
XIIB
Z
y
X

X-RAY TUBE

BACKGROUND OF THE INVENTION

1. Field of the Invention

The present invention relates to an x-ray tube for generating x-rays, and more particularly to a right angle type x-ray tube in which a cylindrical electron gun assembly and a cylindrical target assembly are arranged at right angles.

2. Description of the Related Art

X-rays are a type of electromagnetic radiation that easily penetrates many kinds of materials and objects. This phenomenon is used to produce x-ray images to observe insides of various objects without contacting or destructing the objects.

X-ray tubes for generating x-rays have been proposed as one type of electron tube. The x-ray tube is constructed from a cylindrical electron gun assembly and a cylindrical target assembly. In the electron gun assembly, electrons are generated and then accelerated. Electrons are then introduced into the target assembly. Electrons collide with an x-ray target, whereupon x-rays are emitted from the target. There have been proposed two types of x-ray tubes: an axial type x-ray tube; and a right angle type x-ray tube. In the axial type, the electron gun assembly is arranged axially with the target assembly. In the right angle type, the electron gun assembly is arranged at right angles with and intersecting the target assembly.

U.S. Pat. No. 5,077,771 has proposed one example of the right angle type x-ray tube as shown in FIG. 1. This x-ray tube 900 mainly includes an electron gun assembly 910 and a target assembly 920 which are arranged at right angles.

The electron gun assembly 910 includes a heater 911, a cathode 912, a focus grid 913, and an electron gun container 914 for enclosing all these components. The heater 911 generates heat when supplied with electric power. The cathode 912 emits electrons (thermoelectrons) when heated by the heater 911. The focus grid 913 is supplied with electric voltage to accelerate electrons emitted from the cathode 912 while converging the electrons to produce an electron beam. The electron gun container 914 is formed with an opening through which the electron beam passes. The heater 911, the cathode 912, the focus grid 913, and the opening are arranged along an axis of the electron gun assembly 910.

The target assembly 920 includes a target housing 923, interior of which is communicated with the interior of the electron gun assembly 910 via the opening of the electron gun container 914. A hood electrode 922 is provided in the interior of the housing 923. The hood electrode 922 is of a tube shape in which is enclosed an x-ray target 921. The tube-shaped hood electrode 922 is placed with its axis intersecting at right angles with the axis of the electron gun assembly 910. A higher positive voltage is applied to both the hood electrode 922 and the target 921, than to the focus grid 913. Accordingly, the electron beam emitted from the opening of the electron gun assembly 910 is further accelerated toward the target 921 in the hood electrode 922.

The electron beam enters the hood electrode 922, through an electron beam opening formed in the hood electrode 922, to collide with the upper surface of the target 921, whereupon x-rays are generated. An x-ray opening is formed at an end of the hood electrode 922. An x-ray window 924 made of x-ray translucent material is formed on a radiation-emitting end of the housing 923. X-rays generated at the target 921 therefore pass through the x-ray opening and the x-ray window 924 to emit from the x-ray tube.

In the target assembly 920, an electric field is produced due to the potential difference between the focus grid 913 and the hood electrode 922. Electrons move along the electric field while being accelerated toward the hood electrode 922. In other words, electrons move normal to the equipotential surfaces formed between the focus grid 913 and the hood electrode 922. High speed electrons therefore collide with the target 921, whereupon x-rays are produced. The position on the surface of the target 921, at which the electron beams collide with the target, will be referred to as an x-ray generating point P hereinafter.

SUMMARY OF THE INVENTION

The x-ray tube 900 having the above-described structure can be employed in an article inspection device. The article inspection device is for irradiating x-rays on various articles and for producing magnified x-ray images of the interiors of the articles. Upon observing the magnified images, manufacturers can perform management control of the articles.

FIG. 2 schematically shows a structure of a typical article inspection device 800. An article to be detected is placed on a tray 801. The tray 801 is positioned downstream of the x-ray window 924 of the x-ray tube 900 in the x-ray emitting direction. X-rays emitted from the x-ray tube 900 are therefore irradiated on the article. X-rays penetrate the article and strike an input surface of an x-ray/fluorescence multiplier (an image intensifier tube, for example) 802. As a result, a magnified x-ray image of the article is received on the input surface of the image intensifier 802. The image intensifier 802 converts the magnified x-ray penetration image into a magnified fluorescent image. An image pick-up tube 803 picks up the magnified fluorescent image. The article inspection device is housed in a housing covered with a lead shield 804. An operator can open a door 805 and place an article on the tray 801. 806 is an observation window 805 through which the operator can confirm that the article is properly placed on the tray.

The magnification rate m of the x-ray image is determined depending on the distance a between the article and the x-ray generating position P and the distance b between the article and the input surface of the image intensifier tube 802. That is, the magnification rate m is expressed by the following formula (1):

$$m=(a+b)/a \quad (1)$$

Normally, a is much shorter thank, and therefore the formula (1) can be approximated into the following formula (2):

$$m=b/a \quad (2)$$

It is desirable to increase the magnification rate m into a high value, in order to enhance the inspection rate of the article inspection device. Decreasing a or increasing b can change the magnification rate m into a higher value. Increasing the distance b, however, leads to increase in an overall size of the article inspection device 800, which in turn requires a greater amount of the lead shield 804. In view of this, it is desirable to decrease the distance a.

It is therefore, an object of the present invention to provide an x-ray tube which can decrease the distance a between the x-ray generating point P and the article.

In order to attain the object, the present invention provides an improved x-ray tube, in which the distance between the x-ray generating point P and the x-ray window 924 is shorter than that of the conventional x-ray tube.

The present invention therefore provides an x-ray tube for emitting x-rays, comprising: a cathode for emitting electrons; a focus grid electrode for accelerating the electrons emitted from the cathode, the focus grid being formed with a first opening, the focus grid allowing the accelerated electrons to pass therethrough while converging the electrons, the cathode and the focus grid being arranged along a first direction so as to accelerate electrons in the first direction; a target for generating x-rays upon receiving the accelerated electrons; and an tubular-shaped hood electrode for surrounding the target therein, the tubular-shaped hood electrode being positioned to extend in a second direction perpendicularly to the first direction with the outer peripheral surface of the hood electrode confronting the focus grid electrode, the hood electrode being formed with a second opening for allowing the accelerated electrons having passed through the first opening to pass therethrough to collide with the target at a collision point and an x-ray opening for allowing x-rays generated at the collision point to pass therethrough, the x-ray opening being positioned downstream of the collision point in the second direction, the outer peripheral surface of the hood electrode having a first area extending between an edge of the second opening and an edge of the x-ray opening and a second area extending from the other edge of the second opening in a direction opposite to the second direction, the hood electrode being formed, on the outer peripheral surface thereof at the first area, with a protruded portion protruding toward the focus grid electrode for shifting the collision point in the second direction.

According to another aspect, the present invention provides an x-ray tube for generating x-rays, comprising: a first cylindrical member for accommodating an electron gun, the first cylindrical member extending along its central axis; and a second cylindrical member for enclosing an x-ray target, the second cylindrical member extending along its central axis, the first and second cylindrical members being connected, with the central axes of the first and second cylindrical members extending substantially perpendicularly with each other, wherein the electron gun includes: a cathode for emitting electrons; and at least one focus grid electrode for focusing the electrons emitted from the cathode, the cathode and the focus grid electrode being arranged along the central axis of the first cylindrical member, the focus grid being formed with a first electron opening for causing the electrons to pass therethrough to be emitted outside of the first cylindrical member, wherein the second cylindrical member houses therein a tubular-shaped hood electrode for enclosing therein the x-ray target, the tubular-shaped hood electrode extending, with its central axis parallel to the central axis of the second cylindrical member, the hood electrode being positioned relative to the focus grid electrode so that a periphery of the hood electrode confronts a surface of the focus grid electrode, a second electron opening being formed through the periphery of the hood electrode, on a path of electrons emitted from the first cylindrical member so that electrons enter the hood electrode to collide with the x-ray target and generate x-rays, x-rays emitting in an x-ray emitting direction parallel to the central axis of the hood electrode, the hood electrode having first and second ends opposite to each other along the central axis, the first end being located downstream of the x-ray target in the x-ray emitting direction and the second end being located upstream of the x-ray target, an x-ray opening being formed on the first end for causing x-rays having traveled from the x-ray target to pass therethrough and emit outside of the hood electrode, wherein he second cylindrical member is formed with an x-ray window, at a position downstream of the x-ray opening in the x-ray emitting direction, for causing x-rays emitted from the hood electrode to pass therethrough to emit outside of the x-ray tube, and wherein the hood electrode includes: a first part defined between the second electron opening and the first end; and a second part defined between the second electron opening and the second end, the first part being formed with a protruded portion with its outer diameter being larger than an outer diameter of the second part.

The focus grid electrode may include: a first area downstream of the first electron opening in the x-ray emitting direction; and a second area upstream of the first electrode opening in the x-ray emitting direction, wherein a distance of the surface of the focus grid electrode at the first area from the central axis of the hood electrode is longer than a distance of the outer surface of the focus grid electrode at the second area from the central axis of the hood electrode.

The shape of the first electron opening may be of a rectangular shape with its either longer or shorter side extending parallel to the x-ray emitting direction. The shape of the first electron opening may be of an ellipsoidal shape with its either longer or shorter axis extending parallel to the x-ray emitting direction.

BRIEF DESCRIPTION OF THE DRAWINGS

The above and other objects, features and advantages of the invention will become more apparent from reading the following description of the preferred embodiment taken in connection with the accompanying drawings in which:

FIGS. 5A and 5B show a modification of the hood electrode, wherein FIG. 5A is a front view of the modification of the hood electrode and FIG. 5B is a sectional view of the modification along a Y-Z axial plane;

FIGS. 6A and 6B show another modification of the hood electrode, wherein FIG. 6A is a front view of the modification of the hood electrode and FIG. 6B is a sectional view of the modification along a Y-Z axial plane;

FIGS. 7A and 7B show a still another modification of the hood electrode, wherein FIG. 7A is a front view of the modification of the hood electrode and FIG. 7B is a sectional view of the modification along a Y-Z axial plane;

FIGS. 8A and 8B show another modification of the hood electrode, wherein FIG. 8A is a front view of the modification of the hood electrode and FIG. 8B is a sectional view of the modification along a Y-Z axial plane;

DETAILED DESCRIPTION OF THE PREFERRED EMBODIMENTS

Figure 1:
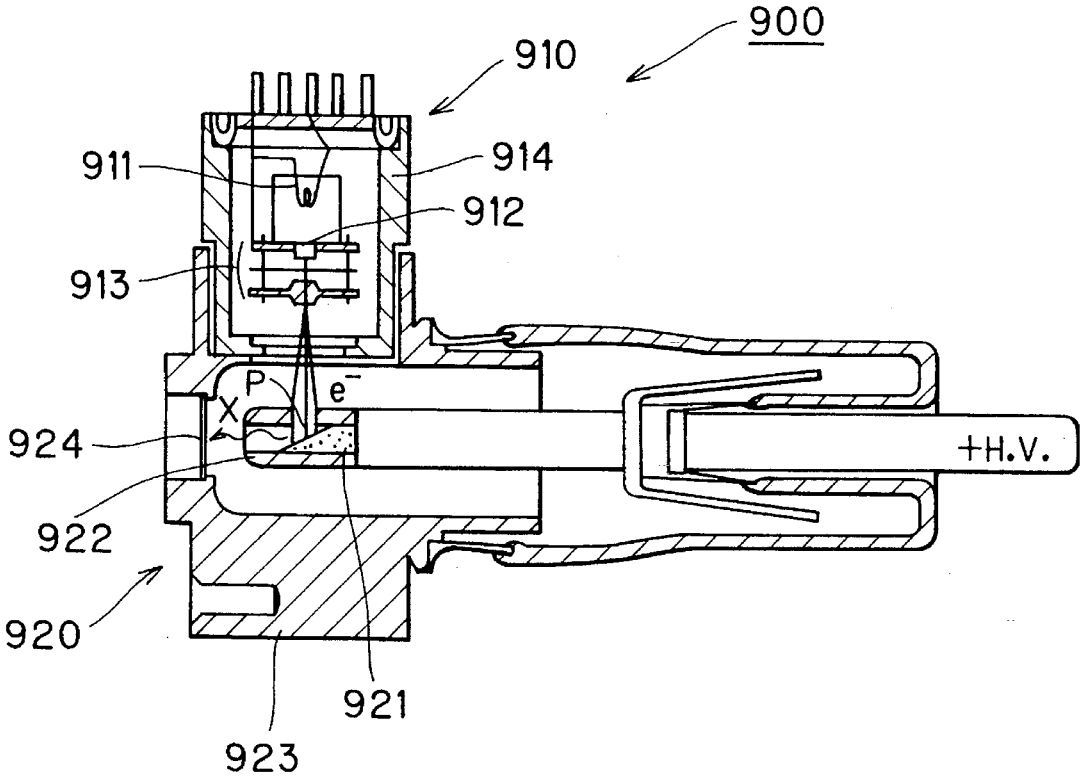
FIG. 1 is a sectional view of a conventional x-ray tube.

An x-ray tube according to preferred embodiments of the present invention will be described while referring to the accompanying drawings wherein like parts and components are designated by the same reference numerals to avoid duplicating description.

An x-ray tube according to a first preferred embodiment will be described below with reference to FIGS. 3 through 9.

Similarly as in the conventional x-ray tube 900 shown in FIG. 1, the x-ray tube 100 of the first embodiment mainly includes an electron gun assembly 110 and a target assembly 210 which are arranged at right angles. More specifically, the electron gun assembly 110 has an axis extending parallel to Z-axial direction, while the target assembly 120 has an axis extending parallel to Y-axial direction.

The electron gun assembly 110 includes a heater 111, a cathode 112, a focus grid unit 113, and an electron gun container 114, similar to the conventional electron gun assembly 910 shown in FIG. 1. That is, the heater 111, the cathode 112, and the focus grid unit 113 are enclosed in the electron gun container 114. The heater 111 is connected to an electric power supply (not shown) provided outside of the x-ray tube 100. The heater 111 generates heat when supplied with electric power. The cathode 112, positioned to confront the heater 111, is also connected to the electric power supply. The cathode 112 emits electrons (thermoelectrons) when heated by the heater 111. The focus grid unit 113 is also connected to the electric power supply. The focus grid unit 113 is supplied with higher voltage, than the cathode 112. The focus gird unit 113 accelerates electrons emitted from the cathode 112 while converging the electrons into an electron beam.

According to the present embodiment, the focus grid unit 113 is constructed from a first focus grid electrode $\mathbf{113}_1$ and a second focus grid $\mathbf{113}_2$. The second focus grid $\mathbf{113}_2$ is constructed from one wall of the electron gun container 114 that is made from conductive material. The first grid electrode $\mathbf{113}_1$ is attached to the second focus grid $\mathbf{113}_2$. The focus grid electrode unit 113 is formed with an opening 115 through which the electron beam passes.

The heater 111, the cathode 112, and the focus grid electrode unit 113 are arranged along the axis of the electron gun assembly 110, i.e., along the Z-axial direction. Electrons accelerated by the focus grid electrode unit 113 are therefore emitted from the electron gun assembly 110 substantially in the Z-axial direction.

The target assembly 210 includes a target housing 213, in which a hood electrode 212 is enclosed. The housing 213 is a cylindrical shape with its axis extending along the Y-axial direction. The electron gun assembly 110 is provided to the peripheral side of the housing 213 so that the axis of the electron gun assembly 110 intersects at right angles with respect to the axis of the cylindrical housing 213. The region of the peripheral side of the housing 213 where the electron gun assembly 110 is connected is opened, so that the second focus grid electrode 1132 is exposed to the interior of the housing 213. The interior of the housing 213 is communicated with the interior of the electron gun assembly 110 via the opening 115.

According to the present embodiment, the hood electrode 212 is also of a cylindrical shape, in which an x-ray target 211 is enclosed. The cylindrical hood electrode 212 extends along the axis of the cylindrical housing 213, i.e., along the Y-axial direction. Accordingly, the axis of the hood electrode 212 intersects at right angles with the axis of the electron gun assembly 110. The axis of the hood electrode 212 extends substantially parallel to the focus grid electrode $\mathbf{113}_2$. The hood electrode 212 is provided so that its peripheral surface confronts the focus grid electrode $\mathbf{113}_2$.

Both the hood electrode 212 and the target 211 are connected to the electric power supply. A higher positive electric voltage is applied to both the hood electrode 212 and the target 211, than to the focus grid unit 113. For example, the hood electrode 212 and the target 211 are supplied with 70 [kV], while the focus grid unit 113 is grounded and the cathode 112 is supplied with −700 [V]. Accordingly, the electron beam emitted from the opening 115 of the electron gun assembly 110 is further accelerated toward the target 211.

An electron beam opening 215 is formed through the hood electrode 212 on a path of the electron beam emitted from the electron gun assembly 110. That is, the electron beam opening 215 is provided on the peripheral side of the hood electrode 212 at a position confronting the opening 115 on the focus grid electrode $\mathbf{113}_2$. An x-ray opening 216 is formed at one end of the cylindrical hood electrode 122 along the Y-axial direction. An x-ray window 214 made of x-ray translucent material, such as beryllium (Be), is formed on a radiation-emitting end of the housing 213 to confront the x-ray opening 216 along the Y-axial direction.

The target 211 made of tungsten (W), for example, is housed or buried in the hood electrode 212 with its upper surface being slanted relative to both the Y-axial and Z-axial directions. The thus slanted upper surface of the target 211 confronts both the electron beam opening 215 and the x-ray opening 216. An electron beam having entered the hood electrode 212 through the electron beam opening 215 therefore collides with the upper surface of the target 211, whereupon x-rays are generated. X-rays travel in an x-ray emitting direction (indicated by an arrow R) along the Y-axial direction, i.e., along the axis of the hood electrode 212. Because the x-ray opening 216 and the x-ray window 214 are positioned downstream of the target 211 in the x-ray emitting direction R, x-rays pass through the x-ray opening 216 and then through the x-ray window 214 to emit from the x-ray tube 100.

In the target assembly 210, an electric field is produced due to the potential difference between the focus grid electrode 113 and the hood electrode 212. Electrons move along the electric field while being accelerated toward the hood electrode 212. In other words, electrons move normal to the equipotential surfaces formed between the focus grid 113 and the hood electrode 212. High speed electrons therefore collide with the target 211, whereupon x-rays are produced.

According to the present invention, a protrusion 212*a* is formed on the periphery of the hood electrode 212 downstream of the electron opening 215 in the x-ray emitting direction R. In this example shown in FIG. 3A, the protrusion 212*a* is a flange shape that protrudes radially outwardly from the hood electrode 212. The protrusion 212*a* is formed at the tip end of the hood electrode 212 where the x-ray opening 216 is formed.

For example, where the outer diameter of the cylindrical hood electrode 212 is 7.0 mm, the outer diameter of the flange 212 can be designed to 8.0 mm.

Figure 4A:
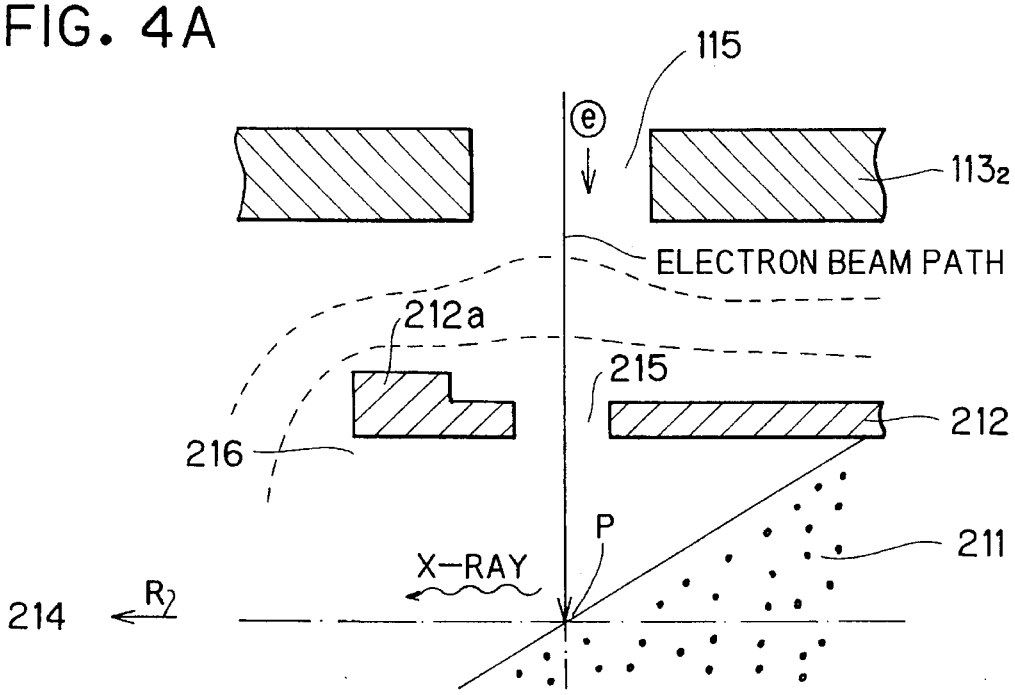
FIG. 4A illustrates how equipotential surfaces are formed and an electron beam path is formed in the space between the focus grid and the hood electrode of the first embodiment that is formed with a protruded portion.

In FIG. 4A, the equipotential surfaces formed in the space between the second focus grid $\mathbf{113}_2$ and the hood electrode 212 are represented by a broken line. The electron beam produced by the electron gun 110 travels normal to the equipotential surfaces in the direction indicated by an arrow. X-rays are generated at an x-ray generating point P where the electron beam traveling path intersects the upper surface of the target 211. X-rays travel in the x-ray emitting direction R.

Figure 2:
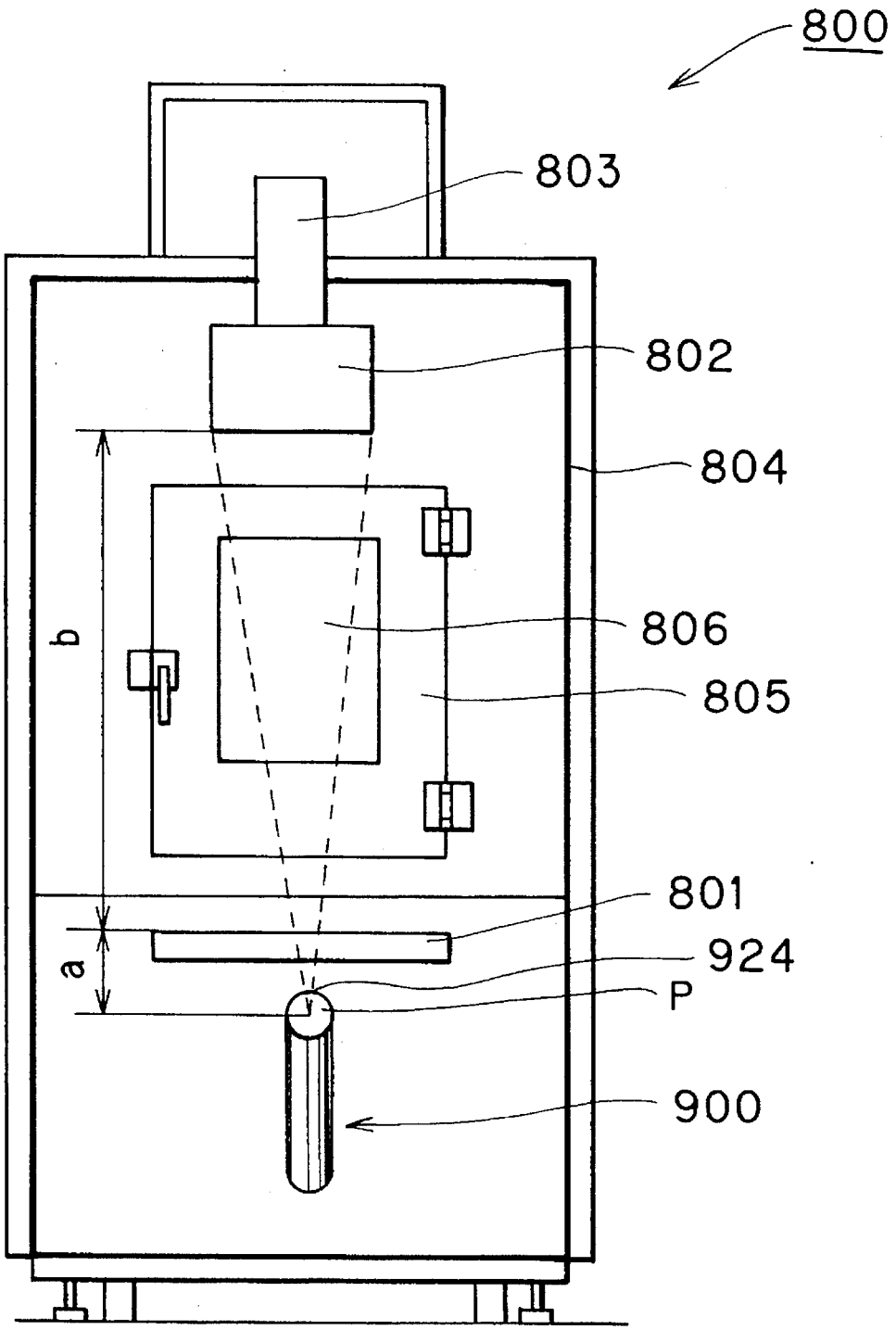
FIG. 2 illustrates an article inspection device employed with the conventional x-ray tube of FIG. 1.
Figure 3A:
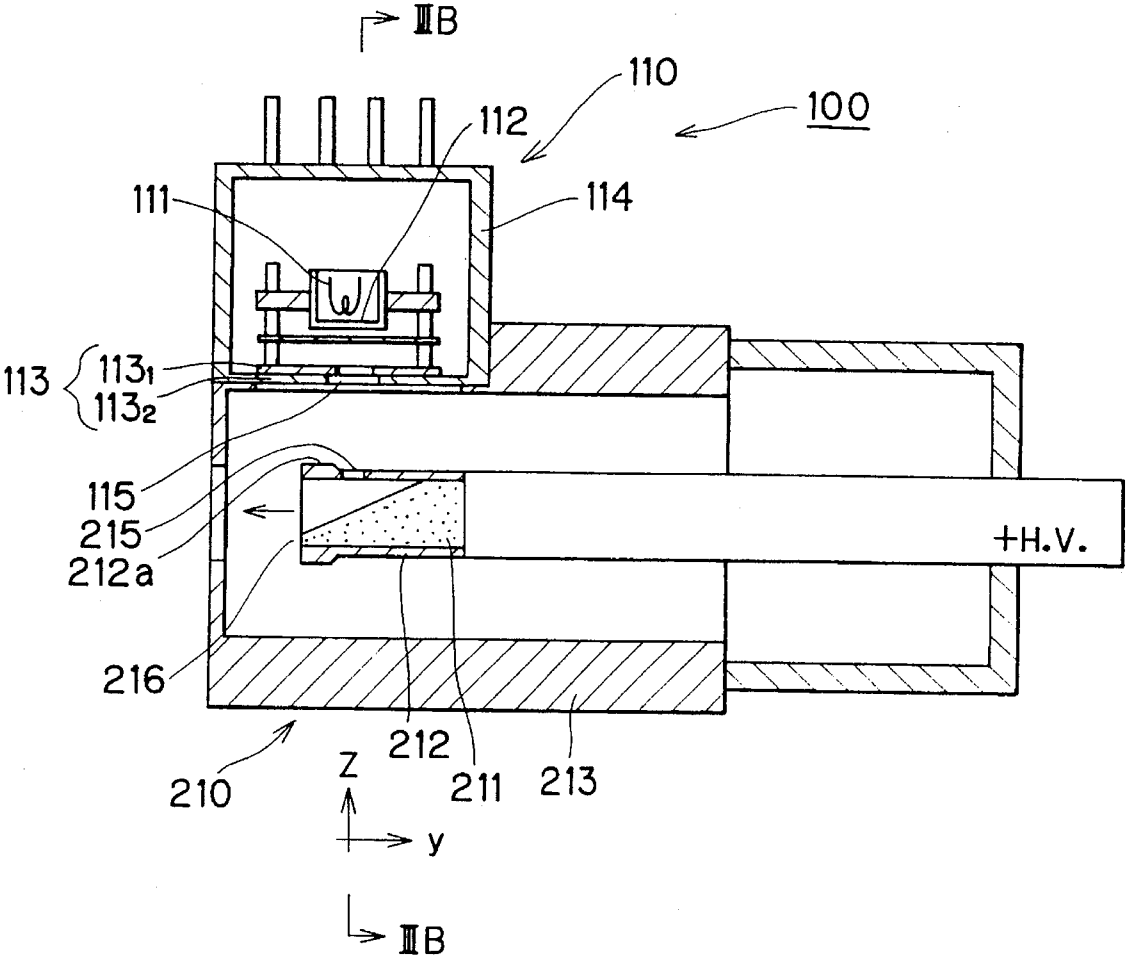
FIG. 3A is a sectional view, along a Y-Z axial plane, of an x-ray tube of a first embodiment of the present invention.
Figure 3B:
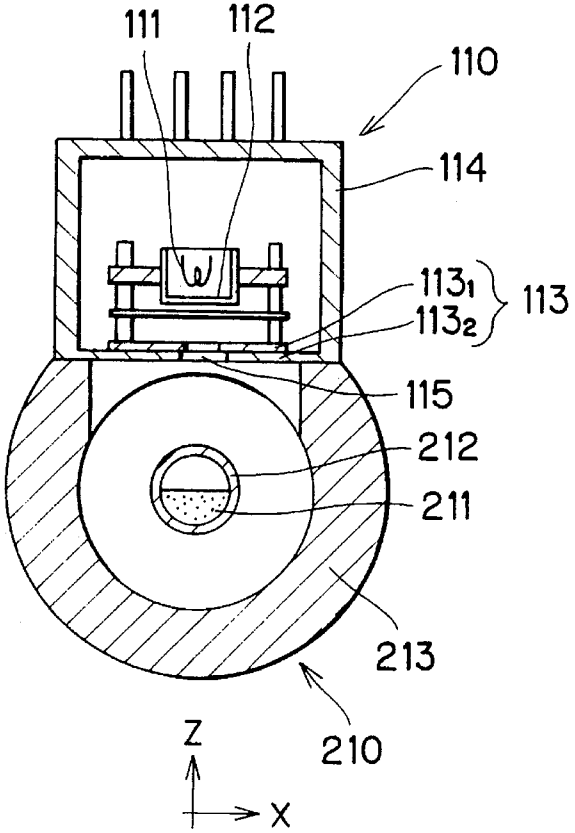
FIG. 3B is a cross-sectional view of the x-ray tube of the first embodiment taken along a line IIIB—IIIB in FIG. 3A.
Figure 4B:
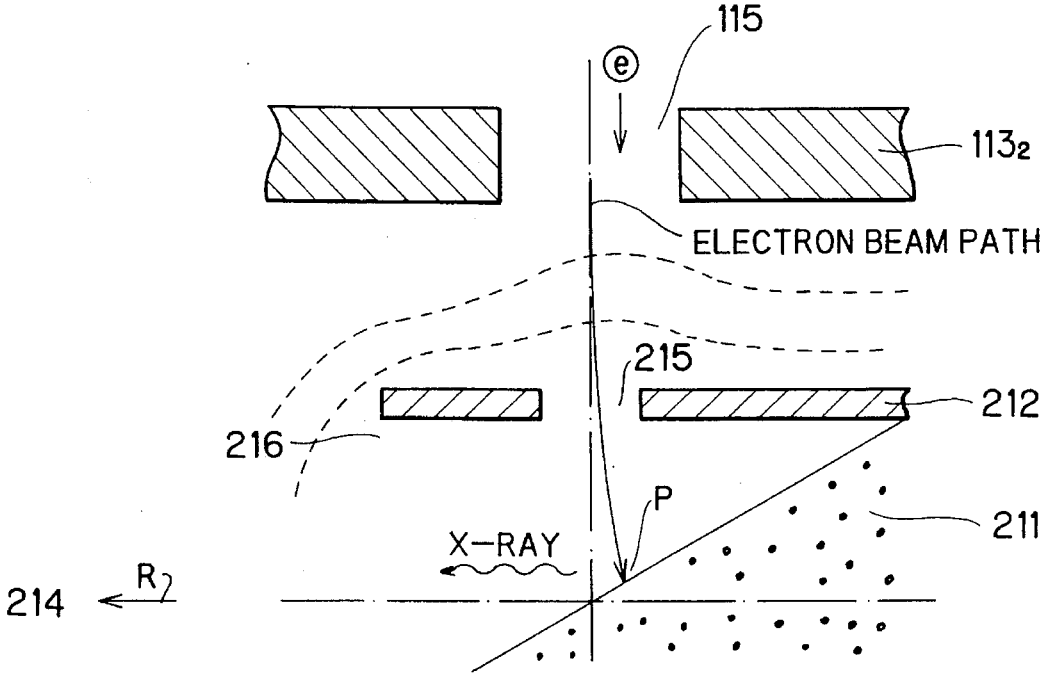
FIG. 4B illustrates how equipotential surfaces are formed and an electron beam path is formed in the space between the focus grid and the hood electrode, if the hood electrode is formed with no protruded portion.

FIG. 4B shows form of equipotential surfaces formed between the second focus grid $\mathbf{113}_2$ and the hood electrode 212 when the hood electrode 212 has no protrusion 212*a* similarly as in the conventional x-ray tube of FIG. 1. An electron beam path and an x-ray generating point P are also shown in FIG. 4B. As apparent from these figures, when the protrusion 212*a* is provided to the hood electrode 212, the equipotential surfaces shift toward the focus grid electrode $\mathbf{113}_2$ in the spatial region between the protrusion 212*a* and the focus grid $\mathbf{113}_2$. The electron beam path therefore shifts toward the x-ray opening 216. As a result, the x-ray generating point P shifts toward the x-ray opening 216 substantially along the axis of the hood electrode 212. The distance between the x-ray generating point P and the x-ray window 214 therefore decreases, which in turn leads to decrease in the distance a between the x-ray generating point P and an article when the x-ray tube 100 is employed in the article inspection device shown in FIG. 2.

Figure 5A:
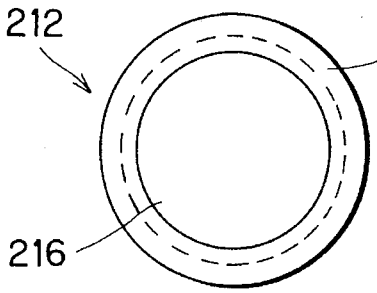
Figure 5B:
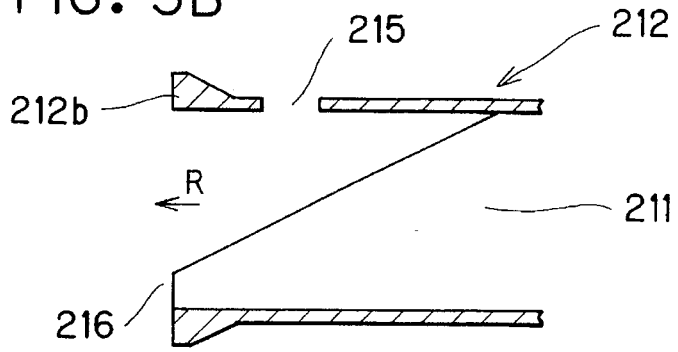
Figure 6A:
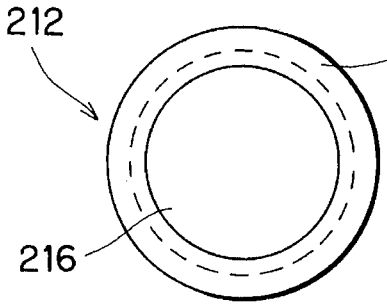
Figure 6B:
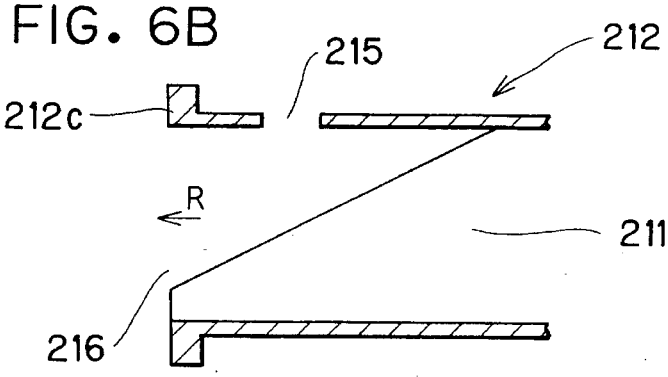
Figure 7A:
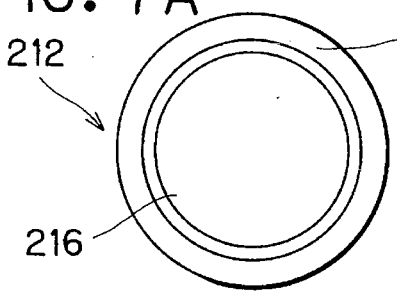
Figure 7B:
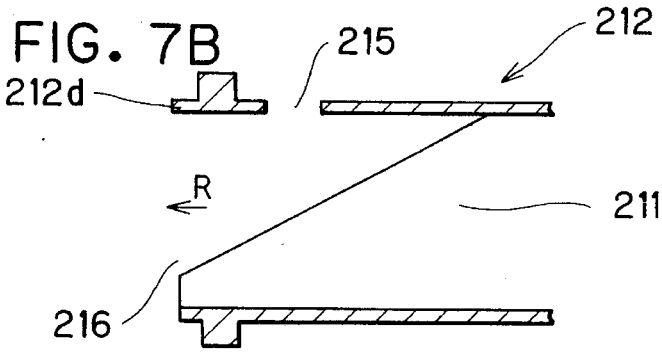

The protrusion 212*a* can be modified into various shapes. For example, FIGS. 5A and 5B show a protrusion 212*b* tapered toward the electron opening 215. A protrusion 212*c* shown in FIGS. 6A and 6B protrudes radially to a greater extent than the protrusion 212*a* of FIG. 3A. The width of the protrusion 212*c* is smaller than that of the flange 212*a* of FIG. 3A. In FIGS. 7A and 7B, a protrusion 212*d* is formed between the tip end and the electron beam opening 215.

Figure 8A:
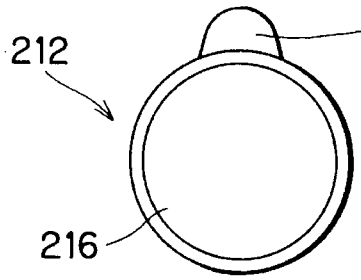
Figure 8B:
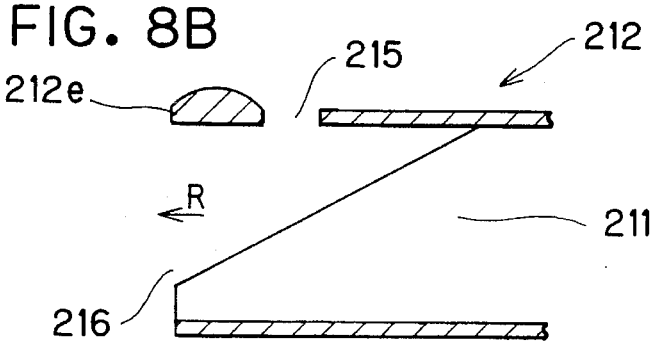

In each of FIGS. 3 through 7, the protrusion is of a flange shape provided entirely around the hood electrode 212. However, the protrusion can be provided partly around the hood electrode 212 at least in a region confronting the focus grid electrode $\mathbf{113}_2$. The protrusion can be provided at any position downstream of the electron beam opening 215. For example, a rounded or curved protrusion 212*e* can be provided extending from the tip end toward the electron opening 215, as shown in FIGS. 8A and 8B.

As described with reference to FIG. 4A, a protrusion provided downstream of the hood electrode 212, as shown in each of FIGS. 5–8, shifts equipotential surfaces toward the focus grid electrode $\mathbf{113}_2$ in the spatial region downstream of the openings 115 and 215, thereby causing the x-ray generating point P to shift toward the x-ray window 214.

Figure 9:
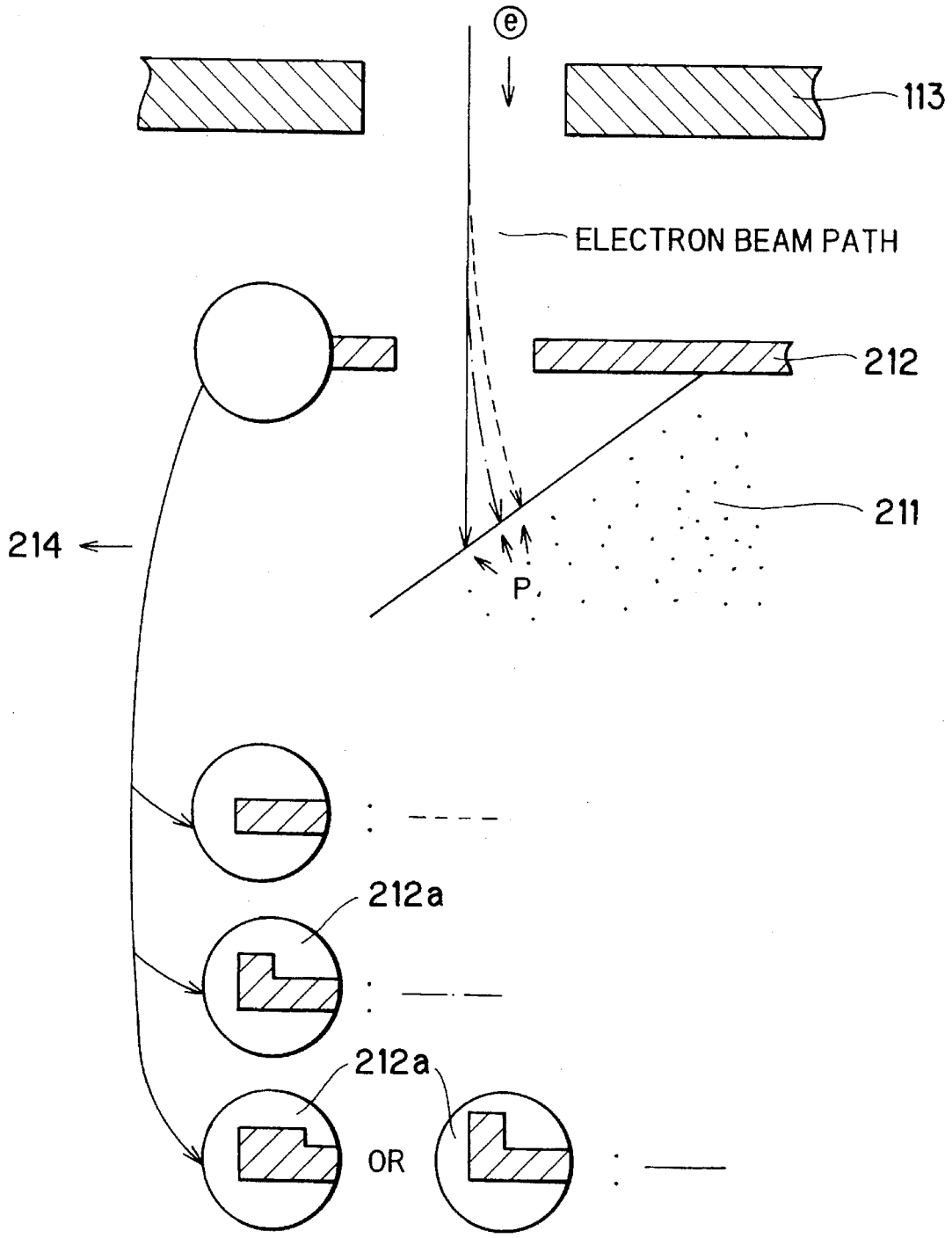
FIG. 9 illustrates how the electron beam path shifts according to the height and width of the protruded portion.

FIG. 9 shows how the electron beam shifts according to the height or width of the protrusion 212*a*. In FIG. 9, the electron beam path indicated by the broken line is produced when no protrusion is formed on the hood electrode. The electron beam path indicated by dot-and-chain line is produced when the protrusion 212*a* is formed on the hood electrode. The electron beam path indicated by solid line is produced when the height or width of the protrusion 212*a* is increased. As apparent from this figure, the higher the protrusion 212*a*, the closer the x-ray generating point P to the x-ray window 214. Similarly, the wider the protrusion 212*a*, the closer the x-ray generating point P to the x-ray window 214.

A second preferred embodiment will be described below with reference to FIGS. 10A through 11.

Except for the electron beam opening 115, a housing 223 (which corresponds to the housing 213 of the first embodiment) is not opened between a second focus grid $\mathbf{123}_2$ (which correspond to the second focus grids $\mathbf{113}_2$ of the first embodiment) and the interior of the housing 223. The housing 223, at least around the electron beam opening 115, is made from a conductive material and forms a third focus grid $\mathbf{123}_3$.

The third focus grid $\mathbf{123}_3$ cooperates with the second focus grid $\mathbf{123}_2$ and a first focus grid $\mathbf{123}_1$ (which corresponds to the first focus grid $\mathbf{113}_1$ of the first embodiment) to serve as a focus grid electrode unit 123. The third focus grid electrode $\mathbf{123}_3$ confronts the hood electrode 212.

Figure 10A:
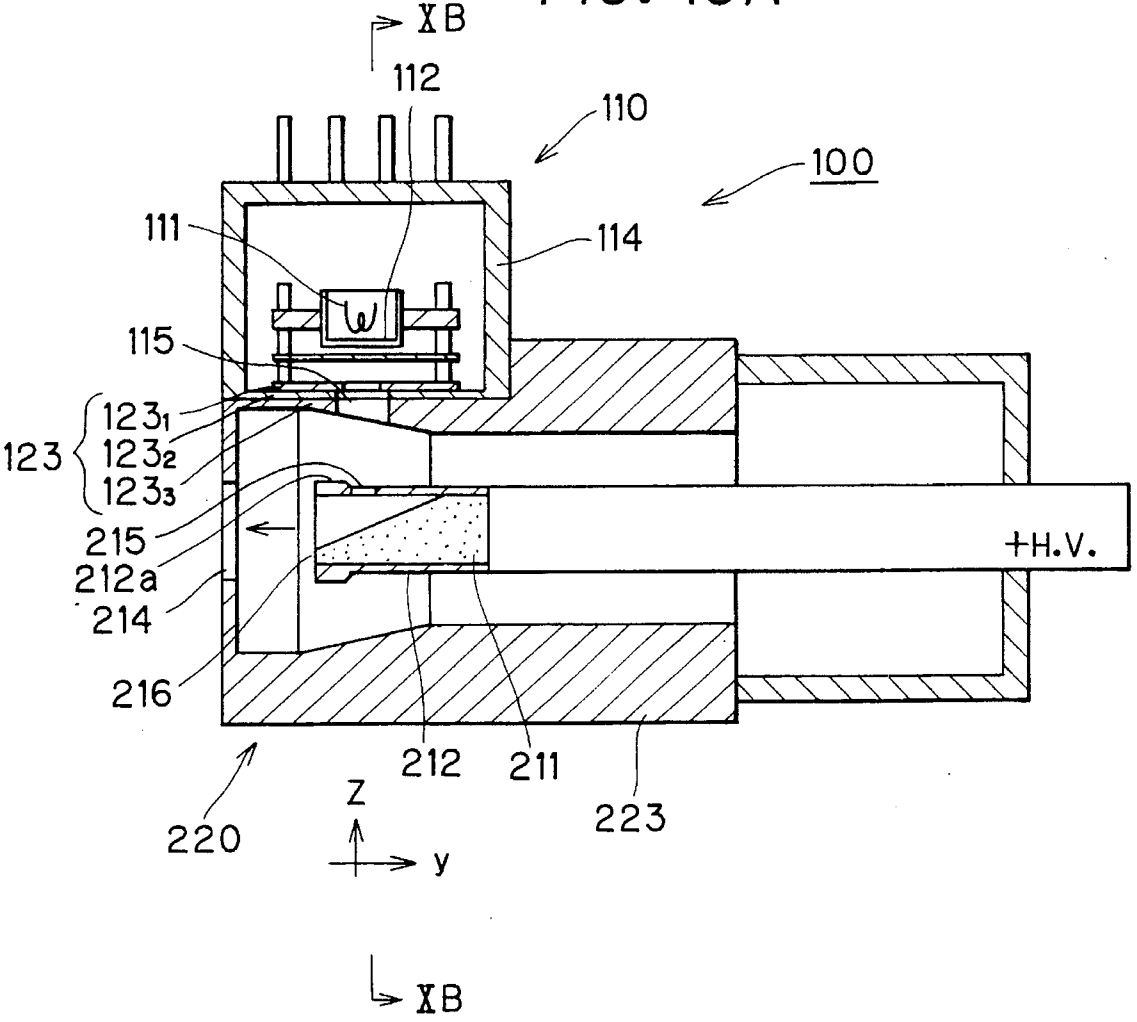
FIG. 10A is a sectional view, along a Y-Z axial plane, of an x-ray tube of a second embodiment of the present invention.
Figure 10B:
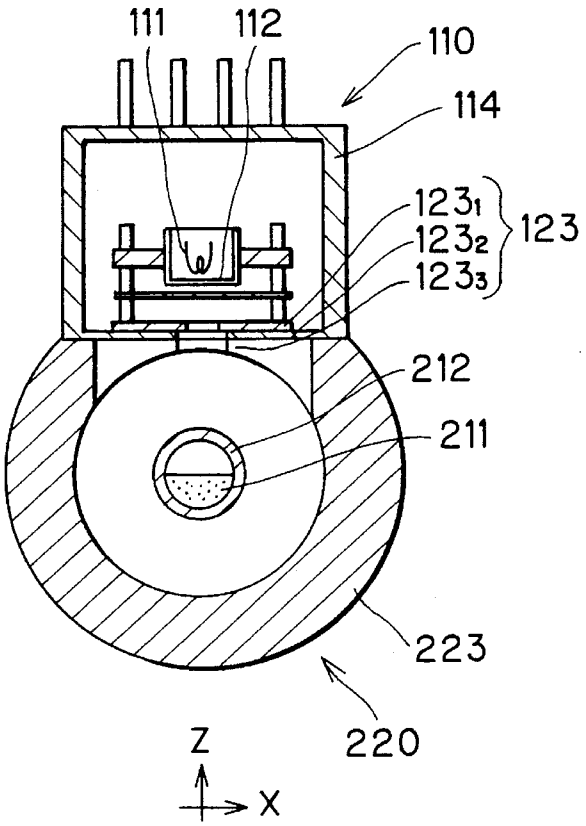
FIG. 10B is a cross-sectional view of the x-ray tube of the second embodiment taken along a line XB—XB in FIG. 10A.

As shown in FIGS. 10A and 10B, the interior surface of the housing 223 around the electron beam opening 115 is slanted along the Y-axial direction. In other words, the surface of the third focus grid electrode $\mathbf{123}_3$ confronting the hood electrode 212 is slanted along the Y-axial direction. Accordingly, the distance between the surface of the third focus grid electrode $\mathbf{123}_2$ and the axis of the hood electrode 212 increases toward the x-ray window 214, in the region around the electron beam opening 215.

The structure of the x-ray tube of the present embodiment is the same as that of the first embodiment, except for the above-described points.

Figure 11:
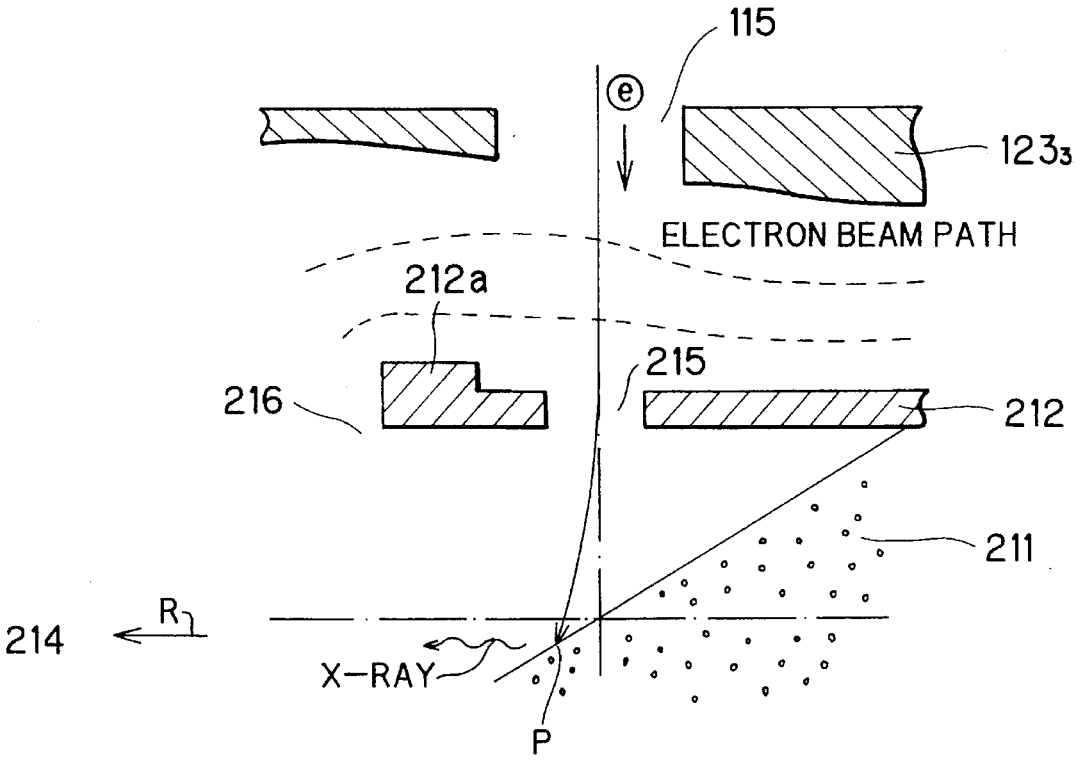
FIG. 11 illustrates how equipotential surfaces are formed and an electron beam path is formed in the space between the focus grid and the hood electrode of the second embodiment.

FIG. 11 shows the equipotential surfaces formed due to the electric potential differences between the focus grid electrode $\mathbf{123}_3$ and the hood electrode 212. The equipotential surfaces are indicated by broken line. An electron beam traveling normal to the equipotential surfaces is also shown in the figure. An x-ray generating point P is also shown. As apparent from this figure, the combination of the slanted shape of the surface of the focus grid $123_3$ and the protrusion 212*a* can shift the equipotential surfaces toward the focus grid $123_2$, in the spatial region downstream of the openings 115 and 215 in the x-ray emitting direction R. The shift amount is larger than that obtained only due to the protrusion 212*a*. Accordingly, the electron beam shifts further toward the x-ray window 214, and the x-ray generating point P shifts further toward the x-ray window along the Y-axial direction.

Also in this embodiment, the shape of the protrusion 212*a* can be modified as shown in FIGS. 5 through 8.

A third embodiment will be described below with reference to FIGS. 12A through 14C.

Figure 13A:
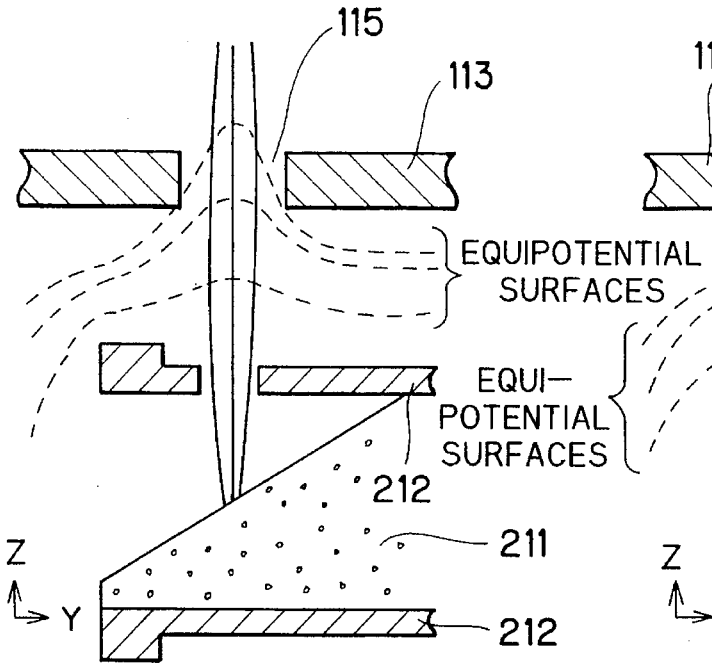
FIG. 13A illustrates how equipotential surfaces are formed in the space to focus an electron beam along a Y-Z plane where an electron beam opening on the focus grid is of circular shape.
Figure 13B:
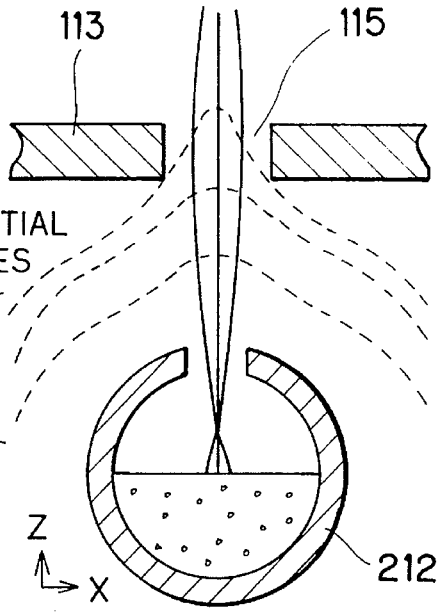
FIG. 13B illustrates how equipotential surfaces are formed in the space to focus an electron beam along a Z-X plane where an electron beam opening on the focus grid is of circular shape.

In the x-ray tube of the above-described first embodiment, the electron beam opening 115 is of a circular shape. FIGS. 13A and 13B show how the equipotential surfaces are produced in the first embodiment. FIG. 13A shows the cross section of the equipotential surfaces along a Y-Z plane, while FIG. 13B showing the cross section along the Z-X plane normal to the Y-Z plane. The degree to which the equipotential surfaces incline in regards to the Y-Z plane determines where the equipotential surfaces focus the electron beam along the Y-Z plane. Similarly, the degree of inclination along the Z-X plane determines where the equipotential surfaces focus the electron beam along the Z-X plane.

Figure 13C:
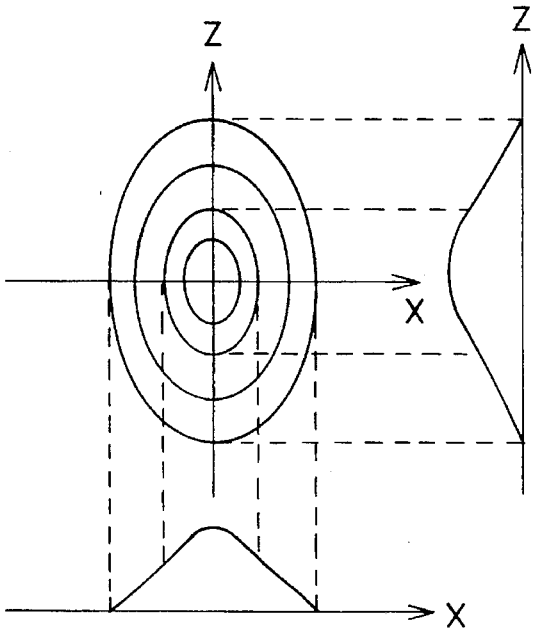
FIG. 13C illustrates how an x-ray having an ellipsoidally-shaped cross-section is generated from the electron beam focused on the x-ray target as shown in FIGS. 13A and 13B.

These figures show, however, that the equipotential surfaces incline to different degrees, along the Y-Z plane than along the Z-X plane. The difference in the inclination degree along the different axial planes causes the electron beam to come to focus at different points. This focus defect is called astigmatism. Astigmatism causes the electron beam to focus into an anisotropic shape, such as an ellipsoidal shape, on the upper surface of the target 211. Accordingly, x-rays will be emitted from the target 211 with an anisotropic (such as an ellipsoidal) cross-section, as shown in FIG. 13C. Images taken with an article inspection device employing this x-ray tube will have resolutions different from each other in their widthwise and lengthwise directions, which will deteriorate detection rate.

The above-described astigmatism is produced mainly because the shapes of and the positional relationship between the focus grid 113 and the hood electrode 212 are different from each other in the X- and Y- axial directions. Astigmatism is therefore produced also in the second embodiment.

Figures 12A, 12B:
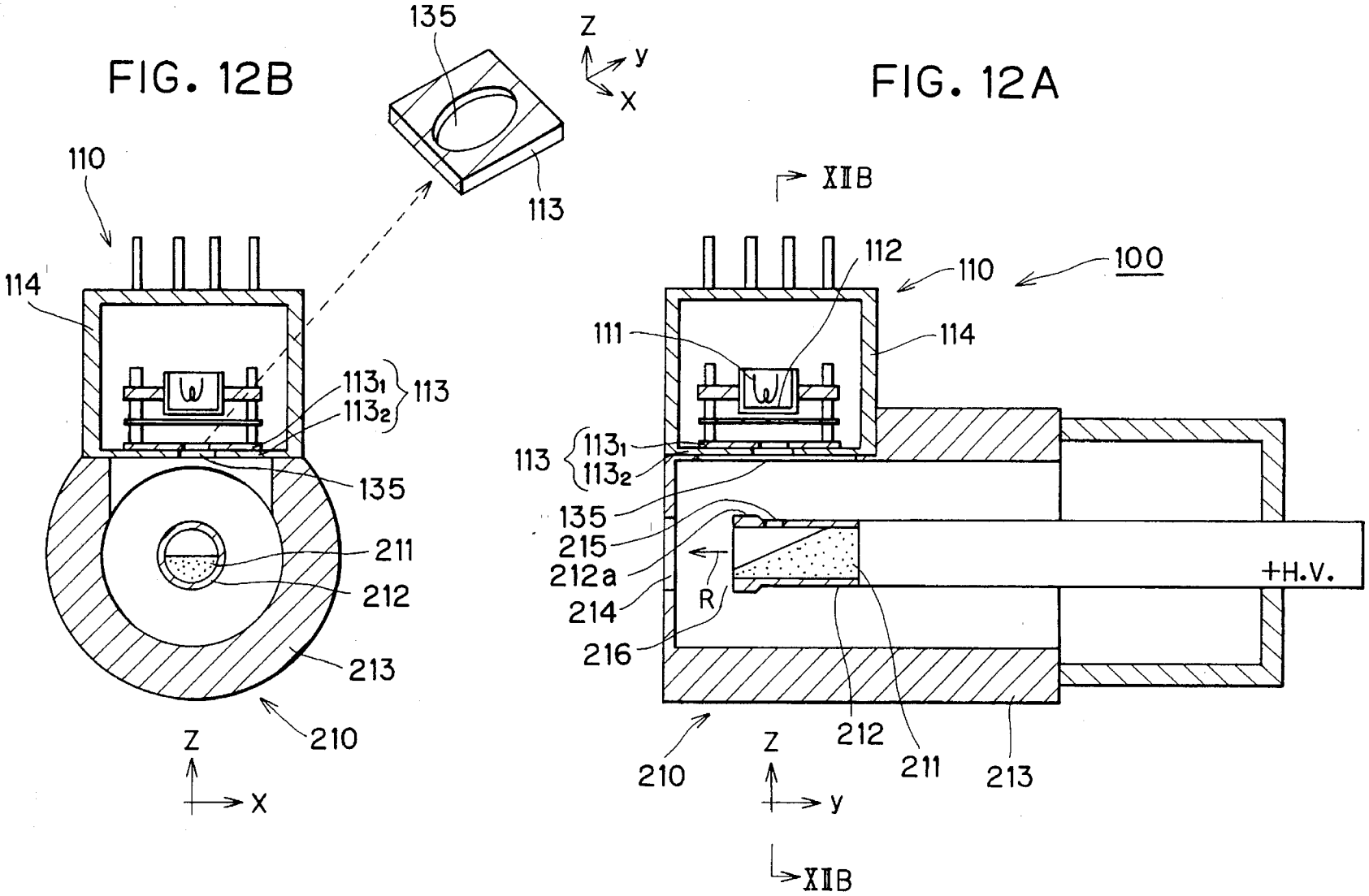
FIG. 12A is a sectional view, along a Y-Z axial plane, of an x-ray tube of a third embodiment of the present invention.
FIG. 12B is a cross-sectional view of the x-ray tube of the third embodiment taken along a line XIIB—XIIB in FIG. 12A.

The third embodiment is provided for eliminating the astigmatism defect. In the third embodiment, as shown in FIGS. 12A and 12B, an anisotropic electron beam opening 135 (corresponding to the electron beam opening 115 of the first and second embodiments) is provided in the X-Y axial plane. For example, the electron beam opening 135 is shaped into an ellipsoidal shape. The anisotropic electron beam opening 135 can be formed with length and width extending in either the X- or Y- axial direction. The anisotropic electron beam opening 135 serves to adjust the equipotential surfaces shown in FIGS. 13A and 13B into those as shown in FIGS. 14A and 14B so as to negate the astigmatism defect.

Figure 14A:
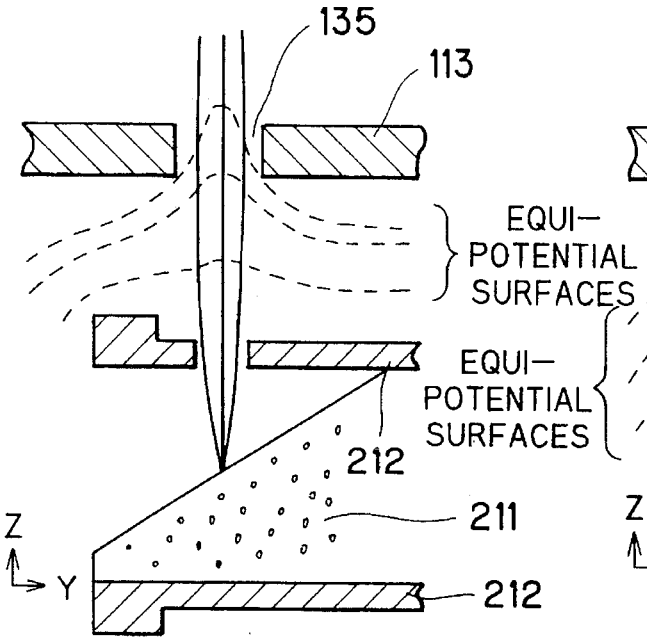
FIG. 14A illustrates how equipotential surfaces are formed in the space to focus an electron beam along a Y-Z plane where an electron beam opening on the focus grid is of ellipsoidal shape.
Figure 14B:
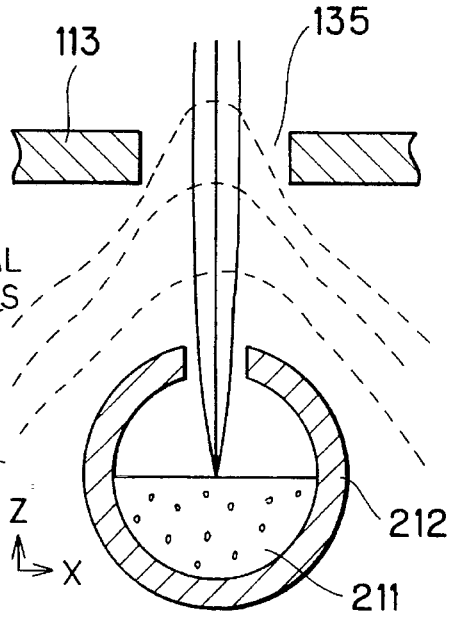
FIG. 14B illustrates how equipotential surfaces are formed in the space to focus an electron beam along a Z-X plane where an electron beam opening on the focus grid is of ellipsoidal shape.
Figure 14C:
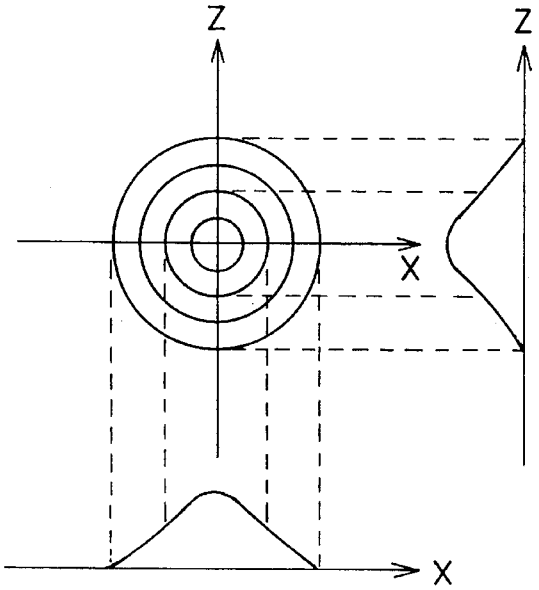
FIG. 14C illustrates how an x-ray having a circular cross-section is generated from the electron beam focused on the x-ray target as shown in FIGS. 14A and 14B.

As shown in FIGS. 14A and 14B, the equipotential surfaces are produced, with their inclination degrees being distributed almost uniformly along the Y-Z and Z-X planes. The astigmatism defect is therefore negated, so that the focusing point is directionally uniform. The resultant x-ray has a circular cross-section as shown in FIG. 14C. The circular-shaped x-ray can obtain x-ray images with their resolutions being uniform in length and width.

The electron beam opening 135 may be shaped into other various anisotropic shapes. For example, the opening 135 may be shaped into a rectangular shape, with length and width extending in either the X- or Y-axial direction.

The modifications of the protrusion 212*a* shown in FIGS. 5–8 may be applied also to the present embodiment. The focus grid 113 may be shaped similarly as in the second embodiment.

While the invention has been described in detail with reference to the specific embodiments thereof, it would be apparent to those skilled in the art that various changes and modifications may be made therein without departing from the spirit of the invention.

As described above, the x-ray tube of the present invention includes: a first cylindrical member for accommodating an electron gun; and a second cylindrical member for enclosing an x-ray target. The first and second cylindrical members are assembled into the x-ray tube, with their central axes extending substantially perpendicularly with each other. The electron gun includes a cathode for emitting electrons and at least one focus grid electrode for focusing the electrons. The cathode and the focus grid electrode are arranged along the central axis of the first cylindrical member. The focus grid is formed with a first electron opening for causing the electrons to pass therethrough to emit outside of the first cylindrical member. In the second cylindrical member, a tubular-shaped hood electrode is provided for enclosing therein the x-ray target. The tubular-shaped hood electrode extends, with its central axis parallel to the central axis of the second cylindrical member. In the second cylindrical member, the hood electrode is positioned relative to the focus grid electrode so that an outer peripheral surface of the hood electrode confronts an outer surface of the focus grid electrode. A second electron opening is formed through the peripheral surface of the hood electrode, on a path of electrons emitted from the first cylindrical member so that electrons enter the hood electrode to collide with the x-ray target and generate x-rays. X-rays emit in an x-ray emitting direction parallel to the central axis of the hood electrode. The hood electrode has two opposite ends, i.e., first and second ends, along its central axis. The first end is located downstream of the x-ray target in the x-ray emitting direction. On the first end of the hood electrode, an x-ray opening is formed for causing x-rays to pass therethrough to be emitted outside of the hood electrode. The second cylindrical member is formed with an x-ray window, at a position downstream of the x-ray opening in the x-ray emitting direction. The x-ray window is for causing x-rays emitted from the hood electrode to pass therethrough. X-rays having passed through the x-ray window are emitted outside of the x-ray tube in the x-ray emitting direction. The hood electrode includes: a first part defined between the second electron opening and the first end; and a second part defined between the second electron opening and the second end.

According to the present invention, the first part is formed with a protruded portion with its outer diameter being larger than an outer diameter of the second part. The protruded portion can shift the equipotential surfaces produced between the focus grid electrode and the hood electrode in a direction toward the focus grid electrode, in the spatial region between the first part of the hood electrode and a part of the focus grid electrode that confronts the first part. Accordingly, the electron beam path along which the electron beam travels from the focus grid electrode toward the x-ray target shifts in the x-ray emitting direction, relative to the case where the hood electrode is formed with no protruded portion. As a result, the distance between the x-ray window and the x-ray generating point, at which the electron beam collides with the target to generate x-rays, becomes shorter, relative to the case where no-protruded portion is provided. An article inspection device employed with the x-ray tube of the present invention is therefore capable of obtaining x-ray images of a higher magnification rate, in comparison with the conventional article inspection device having the same overall size. In other words, it is possible to reduce the overall size of the article inspection device while maintaining the magnification rate to a high value.

Especially according to the second embodiment, the focus grid electrode has: a first area downstream of the first electron opening in the x-ray emitting direction; and a second area upstream of the first electrode opening. The distance of the outer surface of the focus grid electrode at the first area from the central axis of the hood electrode is longer than the distance of the outer surface of the focus grid electrode at the second area from the central axis of the hood electrode. This positional relationship between the focus grid electrode and the hood electrode can shift the equipotential surfaces further toward the focus grid electrode, in the spatial region between the first area of the focus grid electrode and the first part of the hood electrode, resulting that the x-ray generating point shifts further toward the x-ray window. The x-ray tube can therefore increase the magnification rate when applied to the article inspection device.

According to the third embodiment, the shape of the first electron opening is of an ellipsoidal shape with its longer or shorter axis extending along the x-ray emitting direction. The shape may be of a rectangular shape with its longer or shorter side extending parallel to the x-ray emitting direction. This shape of the first electron opening can adjust the form of the equipotential surfaces to negate the astigmatism defect, thereby generating x-rays isotropically. The article inspection device employed with the x-ray tube can obtain x-ray images having uniform resolutions in length and width, resulting in enhancement of the detection rate.

What is claimed is:

1. An x-ray tube for emitting x-rays, comprising:

a cathode for emitting electrons;

a focus grid electrode for accelerating the electrons emitted from the cathode, the focus grid being formed with a first opening, the focus grid allowing the accelerated electrons to pass therethrough while converging the electrons, the cathode and the focus grid being arranged along a first direction so as to accelerate electrons in the first direction;

a target for generating x-rays upon receiving the accelerated electrons; and an tubular-shaped hood electrode for surrounding the target therein, the tubular-shaped hood electrode being positioned to extend in a second direction perpendicularly to the first direction with the outer peripheral surface of the hood electrode confronting the focus grid electrode, the hood electrode being formed with a second opening for allowing the accelerated electrons having passed through the first opening to pass therethrough to collide with the target at a collision point and an x-ray opening for allowing x-rays generated at the collision point to pass therethrough, the x-ray opening being positioned downstream of the collision point in the second direction, the outer peripheral surface of the hood electrode having a first area extending between an edge of the second opening and an edge of the x-ray opening and a second area extending from the other edge of the second opening in a direction opposite to the second direction, the hood electrode being formed, on the outer peripheral surface thereof at the first area, with a protruded portion protruding toward the focus grid electrode for shifting the collision point in the second direction.

2. An x-ray tube of claim 1, wherein the focus grid electrode has an outer surface confronting the hood electrode, the outer surface having a third area extending from an edge of the first opening in the second direction and confronting the first area of the hood electrode and a fourth area extending from the other edge of the first opening in a direction opposite to the second direction and confronting the second area of the hood electrode, the fourth area being positioned closer to the hood electrode than the third area.

3. An x-ray tube of claim 1, wherein the first opening is of an anisotropic shape with respect to the second direction.

4. An x-ray tube of claim 3, wherein the first opening is of an ellipsoidal shape having its either longer or shorter diameter extending in the second direction.

5. An x-ray tube of claim 3, wherein the first opening is of a rectangular shape having its either longer or shorter side extending in the second direction.

6. An x-ray tube of claim 1, further comprising power supply means for applying electric voltage to the focus grid electrode and to the hood electrode.

7. An x-ray tube of claim 1, wherein the collision point shifts further in the second direction as a protrusion amount of the protruded portion increases.

8. An x-ray tube of claim 7, wherein the protrusion amount is a height by which the protrusion portion protrudes from the outer peripheral surface of the hood electrode.

9. An x-ray tube of claim 7, wherein the protrusion amount is a width by which the protrusion portion extends over the outer peripheral surface of the hood electrode.

10. An x-ray tube of claim 1, wherein the protruded portion is slanted.

11. An x-ray tube of claim 1, wherein the protruded portion is curved.

12. An x-ray tube of claim 1, wherein the protruded portion is positioned between the edge of the x-ray opening and the edge of the second opening.

13. An x-ray tube of claim 1, wherein the protruded portion is positioned on the edge of the x-ray opening.

14. An x-ray tube of claim 1, wherein the protruded portion extends from the edge of the x-ray opening to the edge of the second opening.

15. An x-ray tube of claim 2, wherein the outer surface of the focus grid electrode is slanted from the third area toward the fourth area so as to position the fourth area closer to the hood electrode than the third area.

16. An x-ray tube of claim 1, wherein the hood electrode is substantially a cylindrical shape extending along a central axis that extends along the second direction for enclosing therein the target, the hood electrode having a uniform first outer diameter along the central axis, one end of the hood electrode in the second direction being opened to form the x-ray opening, a portion of the hood electrode that is formed with the protruded portion having a second outer diameter larger than the first outer diameter.

17. An x-ray tube of claim 16, wherein the focus grid electrode has an outer surface confronting the hood electrode, the outer surface having a third area extending from an edge of the first opening in the second direction to confront the first area of the hood electrode and a fourth area extending from the other edge of the first opening in a direction opposite to the second direction to confront the second area of the hood electrode, a distance between the fourth area and the central axis of the hood electrode being smaller than a distance between the third area and the central axis.

18. An x-ray tube for generating x-rays, comprising:

a first cylindrical member for accommodating an electron gun, the first cylindrical member extending along its central axis; and a second cylindrical member for enclosing an x-ray target, the second cylindrical member extending along its central axis, the first and second cylindrical members being connected, with the central axes of the first and second cylindrical members extending substantially perpendicularly with each other, wherein the electron gun includes:

a cathode for emitting electrons; and at least one focus grid electrode for focusing the electrons emitted from the cathode, the cathode and the focus grid electrode being arranged along the central axis of the first cylindrical member, the focus grid being formed with a first electron opening for causing the electrons to pass therethrough to be emitted outside of the first cylindrical member, wherein the second cylindrical member houses therein a tubular-shaped hood electrode for enclosing therein the x-ray target, the tubular-shaped hood electrode extending, with its central axis parallel to the central axis of the second cylindrical member, the hood electrode being positioned relative to the focus grid electrode so that a periphery of the hood electrode confronts a surface of the focus grid electrode, a second electron opening being formed through the periphery of the hood electrode, on a path of electrons emitted from the first cylindrical member so that electrons enter the hood electrode to collide with the x-ray target and generate x-rays, x-rays emitting in an x-ray emitting direction parallel to the central axis of the hood electrode, the hood electrode having first and second ends opposite to each other along the central axis, the first end being located downstream of the x-ray target in the x-ray emitting direction and the second end being located upstream of the x-ray target, an x-ray opening being formed on the first end for causing x-rays having traveled from the x-ray target to pass therethrough and emit outside of the hood electrode, wherein he second cylindrical member is formed with an x-ray window, at a position downstream of the x-ray opening in the x-ray emitting direction, for causing x-rays emitted from the hood electrode to pass therethrough to emit outside of the x-ray tube, and wherein the hood electrode includes:

a first part defined between the second electron opening and the first end; and a second part defined between the second electron opening and the second end, the first part being formed with a protruded portion with its outer diameter being larger than an outer diameter of the second part.

19. An x-ray tube of claim 18, wherein the focus grid electrode includes:

a first area downstream of the first electron opening in the x-ray emitting direction; and a second area upstream of the first electrode opening in the x-ray emitting direction, wherein a distance of the surface of the focus grid electrode at the first area from the central axis of the hood electrode is longer than a distance of the outer surface of the focus grid electrode at the second area from the central axis of the hood electrode.

20. An x-ray tube of claim 18, wherein the shape of the first electron opening is of a rectangular shape with its either longer or shorter side extending parallel to the x-ray emitting direction.

21. An x-ray tube of claim 18, wherein the shape of the first electron opening is of an ellipsoidal shape with its either longer or shorter axis extending parallel to the x-ray emitting direction.

* * * * *